US009551284B2

(12) United States Patent
Sohn

(10) Patent No.: US 9,551,284 B2
(45) Date of Patent: Jan. 24, 2017

(54) APPARATUS FOR CONTROLLING CONSTRUCTION EQUIPMENT ENGINE AND CONTROL METHOD THEREFOR

(71) Applicant: DOOSAN INFRACORE CO., LTD., Incheon (KR)

(72) Inventor: Won Sun Sohn, Seoul (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 0 days.

(21) Appl. No.: 14/782,002

(22) PCT Filed: Apr. 2, 2014

(86) PCT No.: PCT/KR2014/002830

§ 371 (c)(1),
(2) Date: Oct. 2, 2015

(87) PCT Pub. No.: WO2014/163393

PCT Pub. Date: Oct. 9, 2014

(65) Prior Publication Data

US 2016/0040610 A1 Feb. 11, 2016

(30) Foreign Application Priority Data

Apr. 4, 2013 (KR) ..... 10-2013-0036615

(51) Int. Cl.
*F02D 31/00* (2006.01)
*F02D 29/04* (2006.01)
(Continued)

(52) U.S. Cl.
CPC ..... *F02D 31/001* (2013.01); *E02F 9/2066* (2013.01); *F02D 29/04* (2013.01); *F02D 41/021* (2013.01)

(58) Field of Classification Search
CPC ..... F02D 29/02; F02D 31/008; F02D 41/021; F02D 41/083; F02D 41/08; F02D 11/02; F02D 1/02; F02D 11/10; F02D 29/00; F02D 29/04; F02D 31/001; E02F 9/2066
(Continued)

(56) References Cited

U.S. PATENT DOCUMENTS 4,792,052 A * 12/1988 Okuda ..... B60K 28/04 123/198 D
5,077,973 A * 1/1992 Suzuki ..... E02F 9/2242 60/368
(Continued)

FOREIGN PATENT DOCUMENTS

JP 2000248975 A 9/2000
JP 2000303872 A * 10/2000 ..... F02D 29/02
(Continued)

OTHER PUBLICATIONS

160324 JP 2000-303872 Takahashi Machine Translation.pdf.*
International Search Report for PCT/KR2014/002830 dated Jul. 3, 2014.

*Primary Examiner* — Erick Solis
*Assistant Examiner* — Carl Staubach
(74) *Attorney, Agent, or Firm* — Hauptman Ham, LLP

(57) ABSTRACT

Disclosed are an apparatus and a method for controlling an engine of construction equipment, the apparatus including: a lever for generating a first signal when a state of the construction equipment is switched to an operation state or a neutral state; and an auto idle switch for generating a second signal when an auto engine idle mode is on; in which when a state of the lever is switched to a neutral state in an on state of the second signal, an engine speed is reduced to a step engine speed, when a first speed reducing step is maintained for a predetermined time, the engine speed is further reduced to an idle engine speed, and when a state of the lever is switched to an operation state while the second
(Continued)

speed reducing step is maintained, the engine speed returned to the step engine speed.

9 Claims, 6 Drawing Sheets

(51) Int. Cl.
*F02D 41/02* (2006.01)
*E02F 9/20* (2006.01)

(58) Field of Classification Search
USPC .... 123/319, 339.1, 339.11–339.29; 701/103, 701/104, 110
See application file for complete search history.

(56) References Cited

U.S. PATENT DOCUMENTS 6,277,050 B1 * 8/2001 Nakagawa ..... F02D 29/04 477/112
6,348,743 B1 * 2/2002 Sakasai ..... H02P 9/305 290/40 A
7,664,586 B2 * 2/2010 Ozawa ..... E02F 9/2235 180/14.1
7,962,768 B2 * 6/2011 Grill ..... E02F 9/2235 701/50
8,374,755 B2 * 2/2013 Lin ..... E02F 9/2246 172/2
8,606,448 B2 * 12/2013 Anders ..... E02F 9/2075 180/65.285
8,909,434 B2 * 12/2014 Anders ..... E02F 9/2075 701/50
2004/0088103 A1 * 5/2004 Itow ..... B60K 6/485 701/110
2005/0149244 A1 * 7/2005 Matsuda ..... E02F 9/26 701/50
2008/0249679 A1 * 10/2008 Matsuda ..... E02F 9/26 701/29.1
2013/0190994 A1 * 7/2013 Narazaki ..... F02D 29/00 701/50
2013/0282242 A1 * 10/2013 Park ..... F02D 29/02 701/50
2014/0008140 A1 * 1/2014 Yoshida ..... F01N 3/0231 180/309
2014/0343829 A1 * 11/2014 Park ..... F02D 41/021 701/110
2014/0350800 A1 * 11/2014 Yoshida ..... F02D 29/02 701/50

FOREIGN PATENT DOCUMENTS

JP 2001090577 A 4/2001
JP 2004339956 A 12/2004
JP 2010084475 A 4/2010
JP 2011256603 A 12/2011

* cited by examiner

APPARATUS FOR CONTROLLING CONSTRUCTION EQUIPMENT ENGINE AND CONTROL METHOD THEREFOR

FIELD OF THE DISCLOSURE

The present disclosure relates to an apparatus and a method for controlling an engine of construction equipment, and more particularly, to an apparatus and a method for controlling an engine of construction equipment, which control an engine by reducing an engine speed to a degree, at which the engine is not stopped, in a state where an operating load is low or there is no operating load in operating construction equipment.

BACKGROUND OF THE DISCLOSURE

In general, a hydraulic system is mounted in construction equipment to operate various operating devices. The hydraulic system operates a hydraulic pump by receiving power from an engine, and various operating devices are operated by working oil discharged from the hydraulic pump. The working device includes an actuator operated by hydraulic pressure.

In the meantime, available torque generated by the engine is limited. Accordingly, an operating load applied to an operating device needs to be operated within a range of the available torque of the engine. When the operating load is close to or exceeds the range of the available torque of the engine, the operating load is hard on the engine. Particularly, in order to generate required torque, the large amount of fuel is momentarily consumed and exhaust gas is generated.

On the other hand, the maintenance of the engine at a rated engine speed even in a low operating load is inefficient in consideration of fuel efficiency. The reason is that when an operating device does not perform an operation or performs an operation having a very small operating load, torque generated by the engine is not used by the operating device and disappears.

As a technology for solving the aforementioned problem, there is an auto engine idle mode maintaining a minimum engine speed at a degree, at which the engine is not stopped. That is, the auto engine idle mode may be a state where the engine is operated, but torque at a degree substantially usable by an operating device is not generated. This is for the purpose of improving fuel efficiency of construction equipment by reducing an engine speed when engine torque is not used.

The auto engine idle mode known in the related art is varied according to whether a lever of a manipulating device is in a neutral state or an operating state, or whether an auto idle switch is selected.

The auto engine idle mode in the related art will be described in more detail below.

When the auto idle switch is in an off state, the engine maintains a high engine speed higher than the rated engine speed regardless of a neutral position or an operation position of the lever.

By contrast, when the auto idle switch is in an on state, the auto engine idle mode is executed only when the lever is at the neutral position, and the engine continuously maintains a high engine speed when the lever is at the operating position.

That is, an apparatus and a method for controlling an engine of construction equipment known in the related art have a problem in that a section, in which a fuel efficiency improvement effect is substantially expectable by the auto engine idle mode, is very limited.

Hereinafter, an apparatus and a method for controlling an engine of construction equipment according to the Comparative Example in the related art will be described in more detail with reference to FIGS. 1 to 3.

FIG. 1 is a diagram for describing an apparatus and a method for controlling an engine of construction equipment according to the Comparative Example. FIG. 2 is a diagram for describing a no-load (idle) section in the apparatus and the method for controlling the engine of construction equipment according to the Comparative Example. FIG. 3 is a diagram for describing an operation case in the no-load (idle) section in the apparatus and the method for controlling the engine of construction equipment according to the Comparative Example.

As illustrated in FIG. 1, reviewing a configuration for performing a control in an auto engine idle mode according to the Comparative Example, a first on/off signal of a lever 12, based on which an operation of construction equipment may be determined, and a second signal indicating whether an auto idle switch 14 is selected are provided to a vehicle control unit (VCU) 10. The VCU 10 generates an engine speed command by calculating an engine speed appropriate in a current situation. The engine speed command is provided to an engine control unit 22, and an engine 20 is operated by the engine speed command.

As illustrated in FIG. 2, in the Comparative Example, when a predetermined time is maintained in a neutral section of an operating device, the engine enters an auto engine idle mode. Here, the predetermined time may be generally set to be within a range from 3 seconds to 10 seconds.

That is, in the Comparative Example, when the lever 12 is not manipulated in a state where the auto idle switch 14 is on, and an engine speed is maintained at a high engine speed RH, a mode of the engine is switched into the engine idle mode. In the engine idle mode, an engine speed is changed into an idle engine speed RI. The idle engine speed RI means that a low engine speed at a degree, at which the engine is not stopped, is maintained as described above.

Then, when the lever 12 is operated, the idle engine speed RI is changed into the high engine speed RH, so that the engine generates large torque at a degree at which an operating device is operable.

In the meantime, when the high engine speed RH is changed into the idle engine speed RI or by contrast, the idle engine speed RI is restored to the high engine speed RH, an inclination of a change of an engine speed to a time is determined by a governing speed of the engine.

Referring to FIG. 3, there is a case where the method of controlling the engine of construction equipment according to the Comparative Example is rather disadvantageous in fuel efficiency.

That is, when the lever 12 is operated in the auto engine idle section, an engine speed is increased at a moment of the operation of the lever 12 to reach the high engine speed RH. Then, the engine speed is varied according to an operating load. For example, an operation of moving a boom up or folding an arm performs digging, which may be a high load operation. During the performance of the high load operation, an engine speed is maintained at a rated engine speed.

In the meantime, when construction equipment performs an operation of moving down the boom or swinging an upper body, the construction equipment may perform a relatively low load operation compared to the high load operation. As described above, during the performance of the low load operation, an engine speed is maintained at a high degree reaching the high engine speed RH.

That is, in the method for controlling the engine of construction equipment in the related art according to the Comparative Example, a high engine speed is rather generated in a low load operation section compared than a high load operation section, and as a result, fuel consumption is increased and fuel efficiency deteriorates. Further, an engine speed is maintained at the high engine speed RH, so that a noise problem is generated.

SUMMARY

The present disclosure is conceived so as to solve the problems in the related art, and an object of the present disclosure is to provide an apparatus and a method for controlling an engine of construction equipment, which are capable of improving fuel efficiency by increasing a fuel efficiency improvement section when controlling an engine of construction equipment.

A technical object to be achieved in the present disclosure is not limited to the aforementioned technical objects, and another not-mentioned technical object will be obviously understood from the description below by those with ordinary skill in the art to which the present disclosure pertains.

In order to achieve the technical object, an exemplary embodiment of the present disclosure provides an apparatus for controlling an engine of construction equipment, the apparatus including: a vehicle control unit 10 configured to control construction equipment; a lever 12 configured to generate a first signal when a state of the construction equipment is switched to an operation state or a neutral state; an auto idle switch 14 configured to generate a second signal when an auto engine idle mode is on; an engine 20 configured to generate power; and an engine control unit 22 configured to control the engine 20 by an engine speed command of the vehicle control unit 10, and generate engine torque information of the engine 20 and provide the generated engine torque information to the vehicle control unit 10, in which when a state of the lever 12 is switched to a neutral state in an on state of the second signal, the vehicle control unit 10 controls the engine control unit 22 so that an engine speed of the engine 20 is reduced to a step engine speed RS corresponding to a first speed reducing step, when the first speed reducing step is maintained for a predetermined time, the vehicle control unit 10 controls the engine control unit 22 so that the engine speed of the engine 20 is further reduced to an idle engine speed RI corresponding to a second speed reducing step, and when a state of the lever 12 is switched to an operation state while the second speed reducing step is maintained, the vehicle control unit 10 controls the engine control unit 22 so that the engine speed of the engine 20 is returned to the step engine speed RS corresponding to the first speed reducing step.

The step engine speed RS corresponding to the first speed reducing step may be within a range equal to or higher than a minimum engine speed, at which operation performance of the construction equipment does not deteriorate, and equal to or lower than a rated engine speed.

The minimum engine speed, at which operation performance of the construction equipment does not deteriorate, may be within a range of an engine speed lower than the rated engine speed by 100 rpm.

When torque information of the engine provided from the engine control unit 22 indicates a high load, the vehicle control unit 10 may control the engine control unit 22 so that the engine 20 is rotated with the rated engine speed.

In order to achieve the technical object, another exemplary embodiment of the present disclosure provides a method for controlling an engine of construction equipment, including: a first speed reducing step, in which when an auto idle switch 14 is on and a state of construction equipment is switched from an operation state to a neutral state, an engine speed is reduced to a step engine speed RS; and a second speed reducing step, in which when the first speed reducing step is maintained for a predetermined time, the engine speed is further reduced to an idle engine speed RI, in which when a lever 12 is manipulated, so that the construction equipment is in the operation state while the second speed reducing step is maintained, the engine speed is controlled so as to be returned to the step engine speed RS corresponding to the first speed reducing step.

The step engine speed RS corresponding to the first speed reducing step may be set to a range from an engine speed lower than the rated engine speed by 100 rpm to the rated engine speed.

The step engine speed RS corresponding to the first speed reducing step may be within a range equal to or higher than a minimum engine speed, at which operation performance of the construction equipment does not deteriorate, and equal to or lower than a rated engine speed.

The minimum engine speed, at which operation performance of the construction equipment does not deteriorate, may be within a range of an engine speed lower than the rated engine speed by 100 rpm.

When the lever 12 is manipulated so that the construction equipment is in the operation state while the second speed reducing step is maintained, and when torque information of the engine 20 of construction equipment provided from the engine control unit 22 indicates a high load, the engine speed may be controlled to be returned to the rated engine speed.

The apparatus and the method for controlling the engine of construction equipment according to the present disclosure, which are configured as described above, may immediately reduce an engine speed to a step engine speed RS when a lever operating an operation device is located at a neutral position, thereby increasing a fuel efficiency improvement section.

Further, the apparatus and the method for controlling the engine of construction equipment according to the present disclosure may reduce an engine speed when a lever is located at an operation position and an operation load is small, thereby expanding a fuel efficiency improvement section.

DETAILED DESCRIPTION

Figure 1:
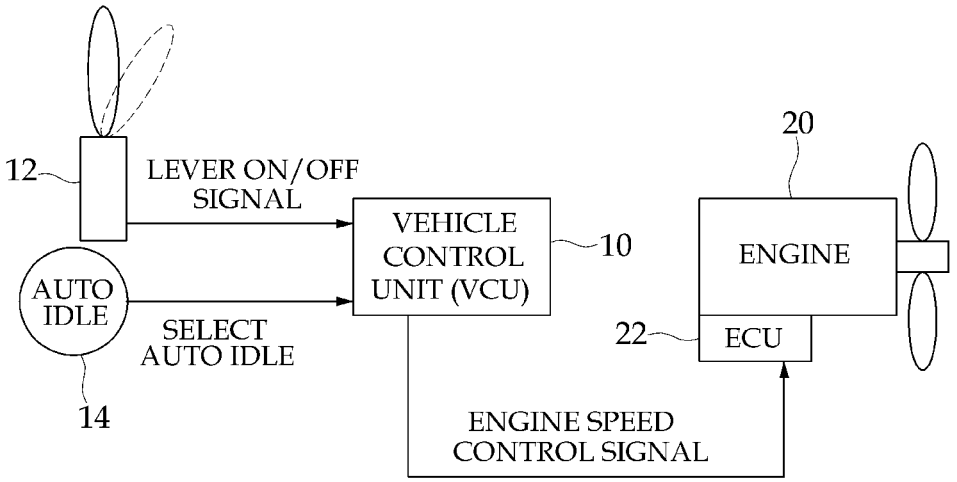
FIG. 1 is a diagram for describing an apparatus and a method for controlling an engine of construction equipment according to a Comparative Example.
Figure 2:
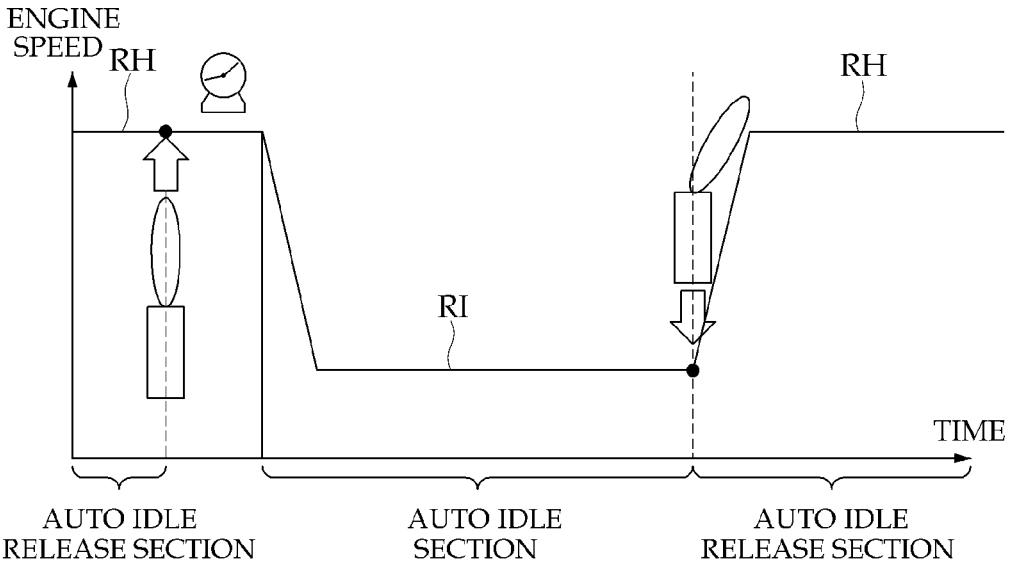
FIG. 2 is a diagram for describing a no-load (idle) section in the apparatus and the method for controlling the engine of construction equipment according to the Comparative Example.
Figure 3:
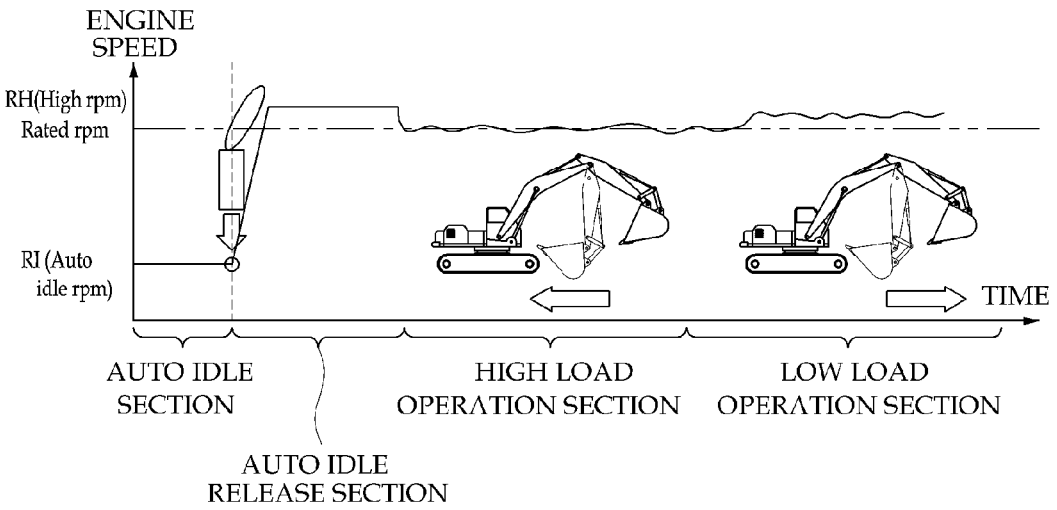
FIG. 3 is a diagram for describing an operation case in the no-load (idle) section in the apparatus and the method for controlling the engine of construction equipment according to the Comparative Example.

Advantages and characteristics of the present disclosure, and a method of achieving the advantages and characteristics will be clear with reference to an exemplary embodiment to be described in detail together with the accompanying drawings.

Hereinafter, an exemplary embodiment of the present disclosure will be described in detail with reference to the accompanying drawings. It should be appreciated that the exemplary embodiment, which will be described below, is illustratively described for helping the understanding of the present disclosure, and the present disclosure may be variously modified to be carried out differently from the exemplary embodiment described herein. In the following description of the present disclosure, a detailed description and a detailed illustration of publicly known functions or constituent elements incorporated herein will be omitted when it is determined that the detailed description may unnecessarily make the subject matter of the present disclosure unclear. Further, the accompanying drawings are not illustrated according to an actual scale, but sizes of some constituent elements may be exaggerated to help understand the present disclosure.

Further, the terms used in the description are defined considering the functions of the present disclosure and may vary depending on the intention or usual practice of a manufacturer. Therefore, the definitions should be made based on the entire contents of the present specification.

Like reference numerals indicate like elements throughout the specification.

Hereinafter, an apparatus and a method for controlling an engine of construction equipment according to an exemplary embodiment of the present disclosure will be described with reference to FIGS. 4 to 8.

Figure 4:
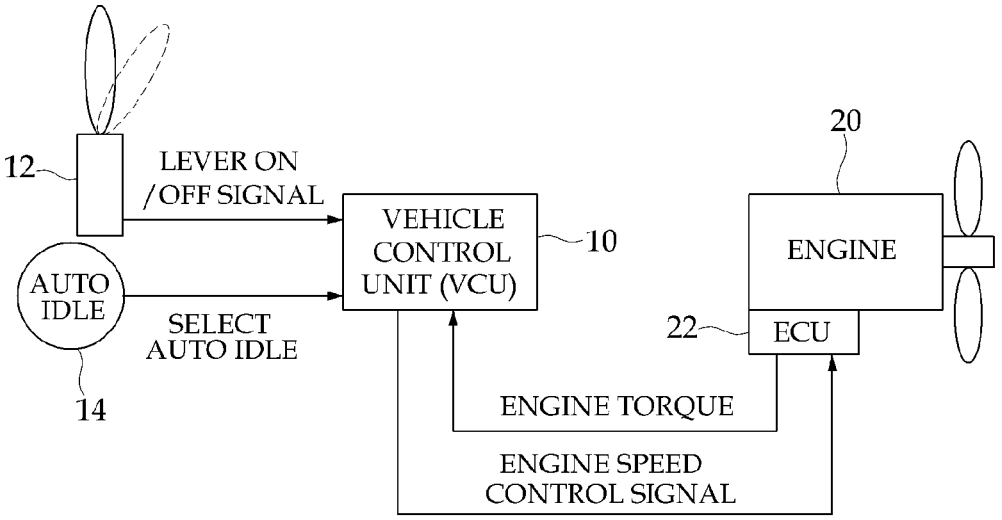
FIG. 4 is a diagram for describing an apparatus and a method for controlling an engine of construction equipment according to an exemplary embodiment of the present disclosure.
Figure 5:
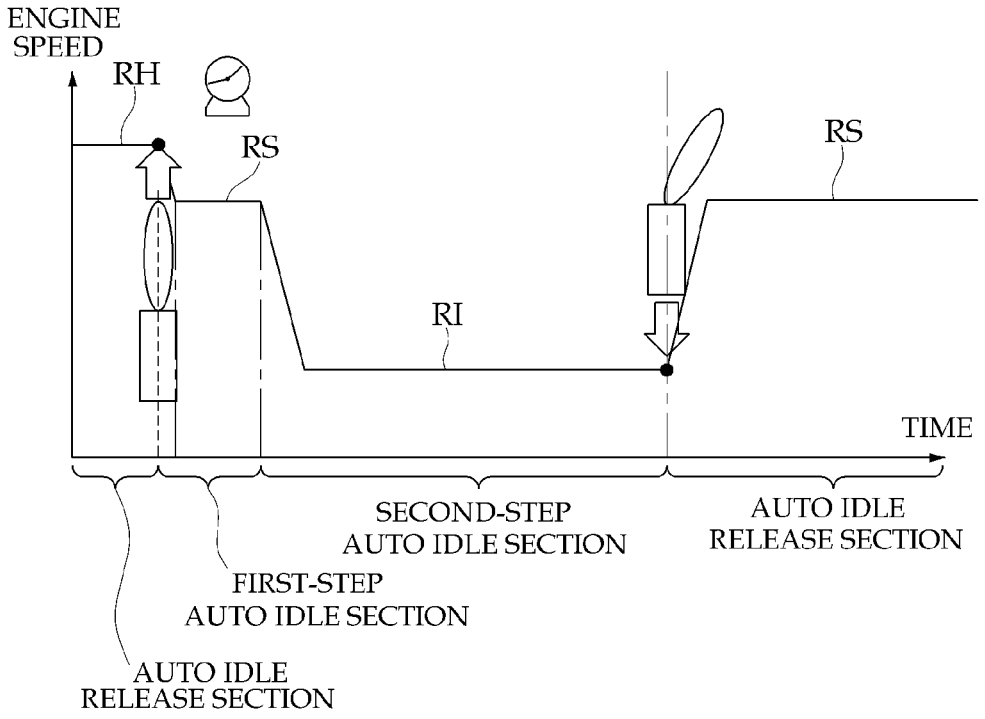
FIG. 5 is a diagram for describing a no-load (idle) section in the apparatus and the method for controlling the engine of construction equipment according to the exemplary embodiment of the present disclosure.
Figure 6:
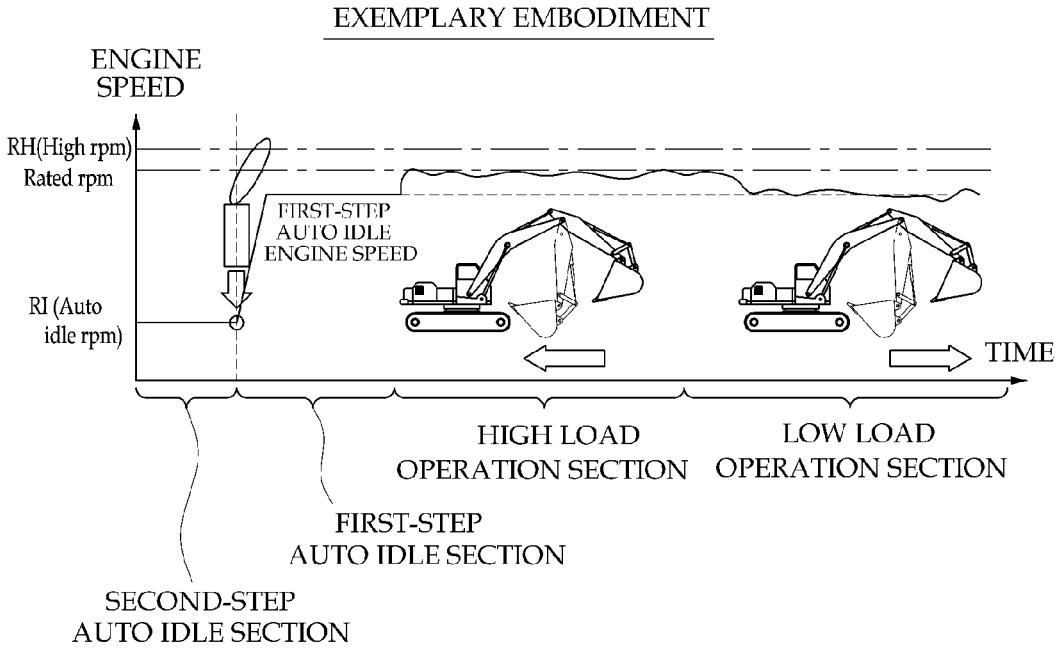
FIG. 6 is a diagram for describing an operation case in the no-load (idle) section in the apparatus and the method for controlling the engine of construction equipment according to the exemplary embodiment of the present disclosure.

FIG. 4 is a diagram for describing an apparatus and a method for controlling an engine of construction equipment according to an exemplary embodiment of the present disclosure. FIG. 5 is a diagram for describing a no-load (idle) section in the apparatus and the method for controlling the engine of construction equipment according to the exemplary embodiment of the present disclosure. FIG. 6 is a diagram for describing an operation case in the no-load (idle) section in the apparatus and the method for controlling the engine of construction equipment according to the exemplary embodiment of the present disclosure.

As illustrated in FIG. 4, the apparatus for controlling an engine of construction equipment according to the exemplary embodiment of the present disclosure includes a vehicle control unit (VCU) 10 controlling construction equipment, a lever 12 generating a first signal when a state of the construction equipment is switched into an operation state or a neutral state, an auto idle switch 14 generating a second signal when an auto engine idle mode is on, an engine 20 generating power, an engine control unit (ECU) 22 controlling the engine 20 by an engine speed command of the VCU 10, and generating engine torque information of the engine 20 and providing the generated engine torque information to the VCU 10, and the like.

When a state of the lever 12 is switched into the neutral state in a state where the second signal is on, the VCU 10 controls the ECU 22 so that an engine speed of the engine 20 is reduced to a step engine speed RS corresponding to a first speed reducing step.

Then, when the first speed reducing step is maintained for a predetermined time, the VCU 10 controls the ECU 22 so that the engine speed of the engine 20 is further reduced to an idle engine speed RI corresponding to a second speed reducing step.

Last, when a state of the lever 12 is switched into the operation state while the second speed reducing step is maintained, the VCU 10 controls the ECU 22 so that an engine speed of the engine 20 is returned to the step engine speed RS corresponding to the first speed reducing step.

Particularly, a configuration for performing an auto idle control by the apparatus for controlling the engine of construction equipment according to the exemplary embodiment of the present disclosure will be described. A first on/off signal of the lever 12, based on which an operation of construction equipment may be determined, and a second signal indicating whether an auto idle switch 14 is selected are provided to the VCU 10. Further, the VCU 10 receives torque information from the ECU 22.

The VCU 10 according to the exemplary embodiment of the present disclosure generates an engine speed command by calculating an engine speed appropriate to a current situation with reference to whether the vehicle is operated, whether an auto idle operation is performed, and the engine torque information. That is, in the exemplary embodiment of the present disclosure, the VCU 10 generates the engine speed command with reference to three kinds of information. The engine speed command is provided to the ECU 22, and the engine 20 is operated by the engine speed command.

A no-load (idle) section in the apparatus for controlling the engine of construction equipment according to the exemplary embodiment of the present disclosure will be described with reference to FIG. 5.

In the exemplary embodiment of the present disclosure, when position of the lever 12 is switched from an operation position to a neutral position in a state where the auto idle switch 14 is on, the engine speed is controlled to be reduced to the step engine speed RS without a delay of time. The first reduction of the engine speed as described above is referred to as the first speed reducing step.

Then, when a predetermined time elapses from a time, at which the engine speed is changed to the step engine speed RS, the engine speed is changed to the idle engine speed RI. The second reduction of the engine speed as described above is referred to as the second speed reducing step. Here, the predetermined time may be set to within a range from 3 seconds to 10 seconds.

The step engine speed RS is provided within a range lower than a rated engine speed and higher than the idle engine speed RI. More particularly, the step engine speed RS may be a minimum engine speed, at which operation performance does not deteriorate. Since the minimum engine speed may be different for each engine of construction equipment, the minimum engine speed cannot be designated as a specific value, and may be set according to a dynamic characteristic of the engine.

That is, it is possible to improve fuel efficiency by decreasing fuel consumption by more rapidly reducing the engine speed to the step engine speed RS at an initial stage of entering the auto engine idle mode.

Then, when the lever 12 is operated, the engine speed is restored from the idle engine speed RI to the step engine speed RS. In this case, in the Comparative Example in the related art, the engine speed is immediately returned from the idle engine speed RI to the high engine speed RH, but in the exemplary embodiment of the present disclosure, the engine speed is returned to the step engine speed RS, which is different from the Comparative Example.

That is, the high engine speed RH is not generated before an operation load is substantially applied, so that it is possible to save fuel by the amount of fuel to be consumed at the high engine speed RH by maintaining the engine speed to be low at the step engine speed RS.

In the meantime, as illustrated in FIG. 6, according to the apparatus for controlling the engine of construction equipment according to the present disclosure, when the auto engine idle mode is released and an operation is performed, the engine speed is generated with the step engine speed RS, and when an operation load is applied, the engine speed is changed from the step engine speed RS to the high engine speed RH, as described above.

The step engine speed RS is set to be lower than the rated engine speed, and is set so that an operator does not have emotional inconvenience when the engine speed is changed from the step engine speed RS to the high engine speed RH.

Here, the step engine speed RS corresponding to the first speed reducing step may be within a range equal to or higher than the minimum engine speed, at which operation performance of the construction equipment does not deteriorate, and equal to or lower than the rated engine speed.

Particularly, the minimum engine speed, at which operation performance of the construction equipment does not deteriorate, may be within an engine speed range lower than the rated engine speed by 100 rpm.

More particularly, in the Comparative Example in the related art, since a difference in an engine speed when the engine speed is generated from the very low idle engine speed RI to the very high engine speed RH is excessively large, an operator may have an inconvenient feeling that an operation speed is delayed when an operating device is operated. By contrast, in the exemplary embodiment of the present disclosure, the engine speed is generated from the idle engine speed RI to the step engine speed RS, and then is generated from the step engine speed RS to the high engine speed RH, so that an operation speed of an operating device is very stable, and the operating device may be smoothly operated.

Particularly, since the same level of engine speed as that of the Comparative Example in the related art is generated when a high load operation is substantially performed, an operation speed of an operating device is not reduced and thus operation performance does not deteriorate.

Further, when the torque information of the engine 20 provided from the ECU 22 indicates a high load, the VCU 10 controls the ECU 22 so that the engine 20 is rotated with the rated engine speed.

In the meantime, in the exemplary embodiment according to the present disclosure, the VCU 10 controls the ECU 22 so that an engine speed is reduced to a level, at which operation performance does not deteriorate in the low load operation section. That is, an engine speed may be reduced to a level of the step engine speed RS in the low load operation section. Accordingly, fuel consumption is decreased according to the reduction of the engine speed, so that fuel efficiency is improved. Further, the engine speed is maintained to be low, thereby achieving an effect of decreasing engine noise.

As described above, according to the apparatus and the method for controlling the engine of construction equipment according to the exemplary embodiment of the present disclosure, when the auto idle switch 14 is on and the lever 14 is located at the neutral position, fuel efficiency may be improved by reducing an engine speed in stages. Further, even when the auto idle switch 14 is on and the lever 14 is located at the operation position, fuel efficiency may be improved by reducing an engine speed even in the low load operation section.

In the meantime, the method for controlling the engine of construction equipment according to another exemplary embodiment of the present disclosure includes a first speed reducing step, a second speed reducing step, and the like, and in the first speed reducing step, when the auto idle switch 14 is on and a state of the construction equipment is switched from the operation state to the neutral state, the engine speed is reduced to the step engine speed RS.

Further, in the second speed reducing step, when the first speed reducing step is maintained for a predetermined time, the engine speed is further reduced to the idle engine speed RI, and when the lever 12 is operated so that the state of the construction equipment is in the operation state while the second speed reducing step is maintained, the engine speed is controlled to be returned to the step engine speed RS corresponding to the first speed reducing step.

Here, the step engine speed RS corresponding to the first speed reducing step may be set to be within a range from an engine speed lower than the rated engine speed by 100 rpm to the rated engine speed.

Further, the step engine speed RS corresponding to the first speed reducing step may be within a range equal to or higher than the minimum engine speed, at which operation performance of the construction equipment does not deteriorate, and equal to or lower than the rated engine speed.

Further, the minimum engine speed, at which operation performance does not deteriorate may be within an engine speed range lower than the rated engine speed by 100 rpm, and when the lever 12 is operated, so that the construction equipment is in the operation state, while the second speed reducing step is maintained, and the torque information of the engine 20 of the construction equipment provided from the ECU 22 indicates a high load, the engine speed is controlled to be returned to the rated engine speed.

Hereinafter, the setting of the step engine speed RS in the apparatus and the method for controlling the engine of construction equipment according to the exemplary embodiment of the present disclosure will be described with reference to FIG. 7.

Figure 7:
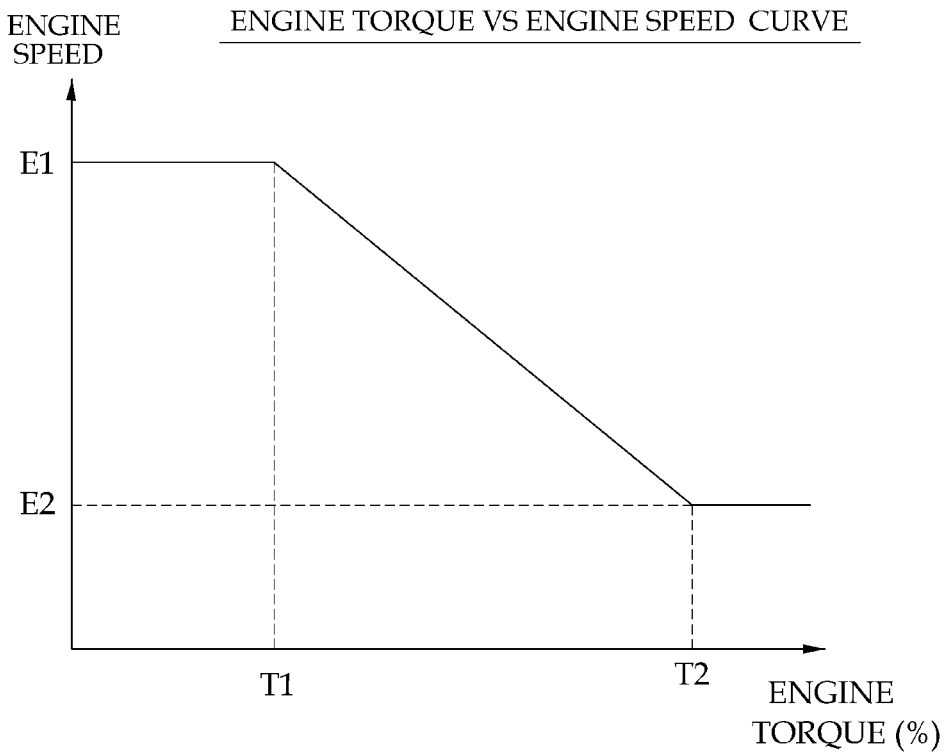
FIG. 7 is a diagram for describing a reduction width of an engine speed in the no-load (idle) section in the apparatus and the method for controlling the engine of construction equipment according to the exemplary embodiment of the present disclosure.

FIG. 7 is a diagram for describing a reduction width of an engine speed in the no-load (idle) section in the apparatus and the method for controlling the engine of construction equipment according to the exemplary embodiment of the present disclosure.

The step engine speed RS according to the exemplary embodiment of the present disclosure is determined by information on engine torque. More particularly, the step engine speed RS is determined by a curve of an engine speed to engine torque.

Torque sections of first torque T1% and second torque T2% are set based on maximum torque of 100% provided from the engine 20. That is, the first torque T1% is a lower limit value, and the second torque T2% is an upper limit value.

When the first and second torque T1% and T2% are substituted in the curve of an engine speed to engine torque, first and second engine speeds E1 and E2 are calculated.

The entrance to the auto engine idle mode is determined by setting the first torque T1% to be higher than the engine torque (%) in the no-load (idle) state by predetermined torque.

That is, a reduction width of an engine speed is set to be equal to or lower than the rated engine speed at the first torque T1% or lower, and is determined at a level, at which operation performance does not deteriorate, when the construction equipment performs a load operation. For example, the reduction width of an engine speed may be set within a range lower than the rated engine speed by 100 rpm. When the reduction width of an engine speed is higher than the rated engine speed, an effect of reducing fuel consumption is slight, so that the reduction width of an engine speed may be maintained at the same level as that of the rated engine speed. Further, when the reduction width of an engine speed is set to be lower than the rated engine speed by 100 rpm or more, a burden may be applied to the engine when the step engine speed RS is changed to the rated engine speed, at which an operation may be performed, or the high engine speed RH. Accordingly, the step engine speed RS may be set within a range equal to the rated engine speed or lower than the rated engine speed by 100 rpm.

A condition for entering an operation, to which an operation load is applied, is set to the second torque T2%, so that the reduction width of the engine speed to the rated engine speed may be set to be minimum or be equal to the rated engine speed during a high load operation.

As an application example of the method for controlling the engine of construction equipment of the exemplary embodiment according to the present disclosure, when construction equipment is set, a reduction width of the first engine speed E1 is an engine speed when the construction equipment enters the auto idle section of a first step, and the second engine speed E2 may be set to be generated within a range similar to that of the rated engine speed or to be equal to the rated engine speed.

A reduction width of an engine speed is determined while a change in engine torque has a predetermined inclination between the first torque T1% and the second torque T2%. The inclination may be linearly provided as illustrated in FIG. 7. Further, the inclination may be provided in a form of a curve line having a predetermined function in consideration of an engine fuel efficiency value.

Hereinafter, an engine speed according to the Comparative Example and an engine speed according to the exemplary embodiment, which are generated when construction equipment is actually operated, will be described through comparison with reference to FIG. 8.

Figure 8:
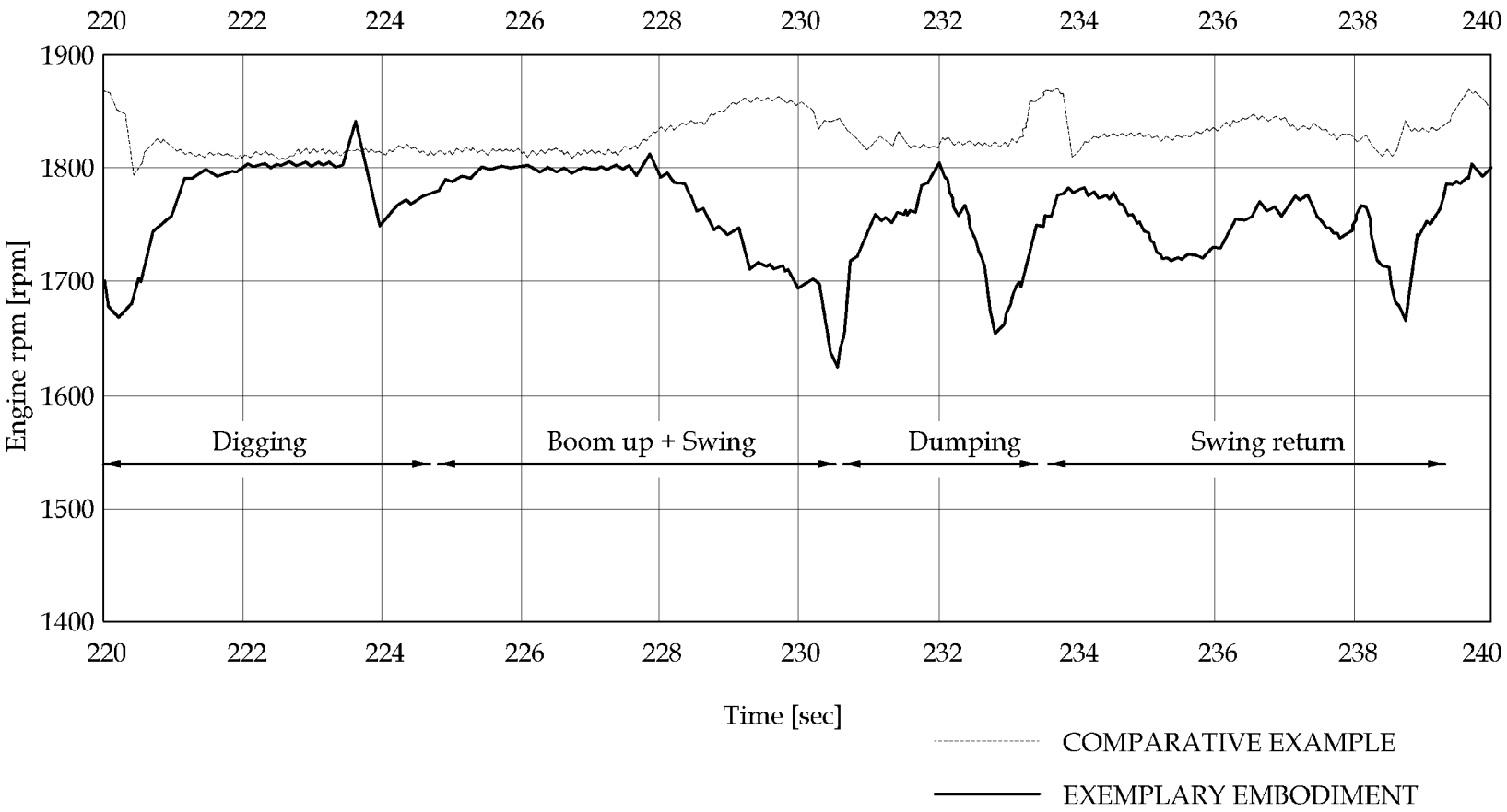
FIG. 8 is a diagram illustrating a comparison between a development of an engine speed according to the Comparative Example and a development of an engine speed according to the exemplary embodiment of the present disclosure when construction equipment is actually operated.

FIG. 8 is a diagram illustrating a comparison between a development of an engine speed according to the Comparative Example and a development of an engine speed according to the exemplary embodiment of the present disclosure when construction equipment is actually operated.

According to an example illustrated in FIG. 8, when a rated engine speed of the engine is 1,800 rpm and a high engine speed is 1,900 rpm, the first engine speed E1 is set to 100 rpm compared to the rated engine speed and the second engine speed E2 is set to 0 rpm compared to the rated engine speed.

The step engine speed RS in the exemplary embodiment of the present disclosure is set to 1,700 rpm in a low load region and is set to 1,800 rpm in a high load region when the engine enters the auto engine idle mode.

Further, the engine speed in the exemplary embodiment of the present disclosure adopts 1,800 rpm, which is a rated engine speed section because engine torque is high in a section, in which a complex operation, such as an excavation operation and a swing operation of a front actuator (a boom, an arm, a bucket, and the like) and the upper body, is performed. Accordingly, operation performance does not deteriorate compared to that of the construction equipment according to the Comparative Example.

Further, the engine speed in the exemplary embodiment of the present disclosure is reduced in a section of a loading and dump operation and an upper body swing returning section in the low load section, thereby improving fuel efficiency and decreasing noise.

Since an operation load is low in the section of the loading and dump operation and the upper body swing returning section, even though the engine speed is reduced by a predetermined portion, the reduction of the engine speed does not influence operation performance.

In contrast, it can be seen that an engine speed in the method of controlling the engine of construction equipment according to the Comparative Example is always maintained to be higher than the rated engine speed (1,800 rpm) regardless of the kind of operation. That is, according to the engine control by the method for controlling the engine of construction equipment according to the exemplary embodiment of the present disclosure, an engine speed is considerably reduced when an operation load is small, and thus fuel consumption is decreased, thereby improving fuel efficiency.

The exemplary embodiments of the present disclosure have been described with reference to the accompanying drawings, but those skilled in the art will understand that the present disclosure may be implemented in another specific form without changing the technical spirit or an essential feature thereof.

Accordingly, it will be understood that the aforementioned exemplary embodiments are described for illustration in all aspects and are not limited, and it should be interpreted that the scope of the present disclosure shall be represented by the claims to be described below, and all of the changes or modified forms induced from the meaning and the scope of the claims, and an equivalent concept thereof are included in the scope of the present disclosure.

The apparatus and the method for controlling the engine of construction equipment according to the exemplary embodiment of the present disclosure may be used for controlling an engine so as to improve fuel efficiency by reducing an engine speed in a no-load (idle) state, in which an operation load is not applied to construction equipment.

What is claimed is:

1. An apparatus for controlling an engine of construction equipment, the apparatus comprising:

a vehicle control unit configured to control construction equipment;

a lever configured to generate a first signal when a state of the construction equipment is switched to an operation state or a neutral state;

an auto idle switch configured to generate a second signal when an auto engine idle mode is on;

the engine configured to generate power; and an engine control unit configured to control the engine by an engine speed command of the vehicle control unit, generate engine torque information of the engine, and provide the generated engine torque information to the vehicle control unit, wherein, when a state of the lever is switched to a neutral state in an on state of the second signal, the vehicle control unit controls the engine control unit so that an engine speed of the engine is reduced to a step engine speed corresponding to a first speed reducing step, when the first speed reducing step is maintained for a predetermined time, the vehicle control unit controls the engine control unit so that the engine speed of the engine is further reduced to an idle engine speed corresponding to a second speed reducing step, and when a state of the lever is switched to the operation state while the second speed reducing step is maintained, the vehicle control unit controls the engine control unit so that the engine speed of the engine is returned to the step engine speed corresponding to the first speed reducing step, and wherein the second signal is maintained in the on state when the engine speed is returned to the step engine speed.

2. The apparatus of claim 1, wherein the step engine speed corresponding to the first speed reducing step is within a range equal to or higher than a minimum engine speed, at which operation performance of the construction equipment does not deteriorate, and equal to or lower than a rated engine speed.

3. The apparatus of claim 2, wherein the minimum engine speed, at which operation performance of the construction equipment does not deteriorate, is within a range of an engine speed lower than the rated engine speed by 100 rpm.

4. The apparatus of claim 1, wherein when torque information of the engine provided from the engine control unit indicates a high load, the vehicle control unit controls the engine control unit so that the engine is operated with the rated engine speed.

5. A method for controlling an engine of construction equipment, the method comprising:

a first speed reducing step, in which when an auto idle switch is on and a state of construction equipment is switched from an operation state to a neutral state, an engine speed is reduced to a step engine speed; and a second speed reducing step, in which when the first speed reducing step is maintained for a predetermined time, the engine speed is further reduced to an idle engine speed, wherein when a lever is manipulated, so that the state of the construction equipment becomes the operation state while the second speed reducing step is maintained, the engine speed is controlled so as to be returned to the step engine speed corresponding to the first speed reducing step, and wherein the auto idle switch generates an auto idle switch signal, and the auto idle switch signal is maintained in an on state of the auto idle switch when the engine speed is returned to the step engine speed.

6. The method of claim 5, wherein the step engine speed corresponding to the first speed reducing step is set to be within a range from an engine speed lower than the rated engine speed by 100 rpm to the rated engine speed.

7. The method of claim 5, wherein the step engine speed corresponding to the first speed reducing step is within a range equal to or higher than a minimum engine speed, at which operation performance of the construction equipment does not deteriorate, and equal to or lower than a rated engine speed.

8. The method of claim 7, wherein the minimum engine speed, at which operation performance of the construction equipment does not deteriorate, is within a range of an engine speed lower than the rated engine speed by 100 rpm.

9. The method of claim 5, wherein when the lever is manipulated, so that the state of the construction equipment becomes the operation state while the second speed reducing step is maintained, and when torque information of the engine of construction equipment provided from the engine control unit indicates a high load, the engine speed is controlled to be returned to the rated engine speed.

* * * * *